US005379531A

United States Patent [19]

Iwama

[11] Patent Number: 5,379,531

[45] Date of Patent: Jan. 10, 1995

[54] SKI BOOT

[75] Inventor: Shinichi Iwama, Tokyo, Japan

[73] Assignee: Daiwa Seiko, Inc., Tokyo, Japan

[21] Appl. No.: 983,050

[22] Filed: Nov. 30, 1992

[30] Foreign Application Priority Data

Dec. 6, 1991 [JP] Japan ..... 3-108521[U]
Jul. 2, 1992 [JP] Japan ..... 4-052052[U]

[51] Int. Cl.[6] ..... A43B 5/04

[52] U.S. Cl. ..... 36/119; 36/50.5; 24/68 SK

[58] Field of Search ..... 36/117–121, 36/50.5; 24/68 SK, 69 SK, 70 SK, 71 SK, 613

[56] References Cited

U.S. PATENT DOCUMENTS

| | | | |
|---|---|---|---|
| 2,980,976 | 4/1961 | Coulter | 24/613 |
| 3,805,334 | 4/1974 | Graup | 24/70 SK |
| 4,685,558 | 8/1987 | Filiz et al. | 206/581 X |
| 4,694,592 | 9/1987 | Baggio et al. | 36/50.5 X |
| 4,719,710 | 1/1988 | Pozzobon et al. | 36/50.5 X |
| 4,765,069 | 8/1988 | Baggio et al. | 36/50.5 |
| 4,796,829 | 1/1989 | Pozzobon et al. | 36/119 X |
| 4,875,299 | 10/1989 | Mabboux et al. | 36/117 |
| 4,949,480 | 8/1990 | Hercog et al. | 36/117 X |
| 5,065,532 | 11/1991 | Gorza | 36/50.5 X |
| 5,170,541 | 12/1992 | Chen | 24/613 |

FOREIGN PATENT DOCUMENTS

| | | | |
|---|---|---|---|
| 0299267 | 7/1987 | European Pat. Off. | 36/117 |
| 63-68803 | 5/1988 | Japan . | |
| 2154701 | 6/1990 | Japan . | |
| 2249501 | 10/1990 | Japan . | |

OTHER PUBLICATIONS

"Raichle/Kavanaugh" Ski Boot.

*Primary Examiner*—Paul T. Sewell
*Assistant Examiner*—Ted Kavanaugh
*Attorney, Agent, or Firm*—Longacre & White

[57] ABSTRACT

A fastening device 7 for fastening a skier's foot inserted in an outer shell 1 of a ski boot. A lock member 17 having an operation portion 16 and an engagement portion 15 is disposed in one of a clamping-lever 11 or the outer shell 1, and an engagement portion 20 is provided in the other. The engagement portion 15 of the lock member 17 can be resiliently moved by a biasing spring 18 into engagement with the engagement portion 20 to thereby secure and hold the clamping lever 11 at the clamping position thereof. This makes it sure to prevent the clamping lever from releasing its clamping force due to shocks given when the skier skis in a heavily bumpy slope.

12 Claims, 5 Drawing Sheets

SKI BOOT

BACKGROUND OF THE INVENTION

The present invention relates to a ski boot and, more particular, to a fastening device which is used in a ski boot to fasten and hold a foot within an outer shell of the ski boot.

Generally, a conventional ski boot includes a front entry system boot into which a foot is inserted from the front side of the boot, and a rear entry system boot into which a foot is inserted from the rear side thereof. As disclosed in Japanese Patent Publications No. 2-249501 of Heisei and No. 2-154701 of Heisei, in either of the front and rear entry systems, fastening and holding of the foot within the outer shell of the boot after the foot is inserted is currently performed by a fastening device which utilizes the dead point action of a clamping lever with respect to a shaft support point.

However, the clamping action of the clamping lever is sometimes released by shocks given when a skier wearing such ski boots skies in a bumpy slope, which provides a trouble in skiing to the skier and even puts the skier into a dangerous condition. In order to improve this, there is disclosed in Japanese Utility Model Publication No. 63-68803 of Showa a fastening device in which the holding force of a clamping lever is increased by use of a magnet. However, even the improved clamping lever is not able to accomplish its object, that is, it is not able to provide sufficient holding force to bear against the shocks given in skiing, and also corrosion unfavorably occurs. Further, the clamping lever using the dead point action requires a greater force than necessary for its opening and closing operation, especially, for an opening operation, which results in a poor operationability. The present invention aims at eliminating the drawbacks found in the prior art devices and it is an object of the invention to provide a fastening device for use in a ski boot which is able to surely fasten and hold a fastening lever.

SUMMARY OF THE INVENTION

In order to attain the above-noted object, according to the invention, there is provided in the outside of an outer shell of a ski boot a fastening device using a clamping lever which is used to hold tightly a foot of a skier within the outer shell. Also, there is provided a lock member including an operation portion which is used to secure and hold the clamping lever in the clamping state thereof.

The lock member may be arranged in two main ways: that is, in one way, the lock member is provided in the clamping lever such that it is free to move resiliently in the locking direction and there is provided in the outer shell an engagement portion with which the lock member is engageable; and, in the other way, the lock member is provided in the outer shell such that it is free to move resiliently in the locking direction, and there is provided in the clamping lever an engagement portion with which the lock member is engageable. Also, there can be also used for the fastening device a clamping lever a type which does not provide a dead point action for its opening and closing operation. Further, the fastening device is preferably mounted to a rear cuff which is Supported in a shell main body such that it can be released backwardly.

With the lock member held in a state not engaged with the engagement portion, the clamping lever is rotated to its clamping position and is thus brought into resilient engagement with the engagement portion, so that the clamping lever can be held in its clamping state at its clamping position.

DETAILED DESCRIPTION OF THE PREFERRED EMBODIMENTS

Figure 1:
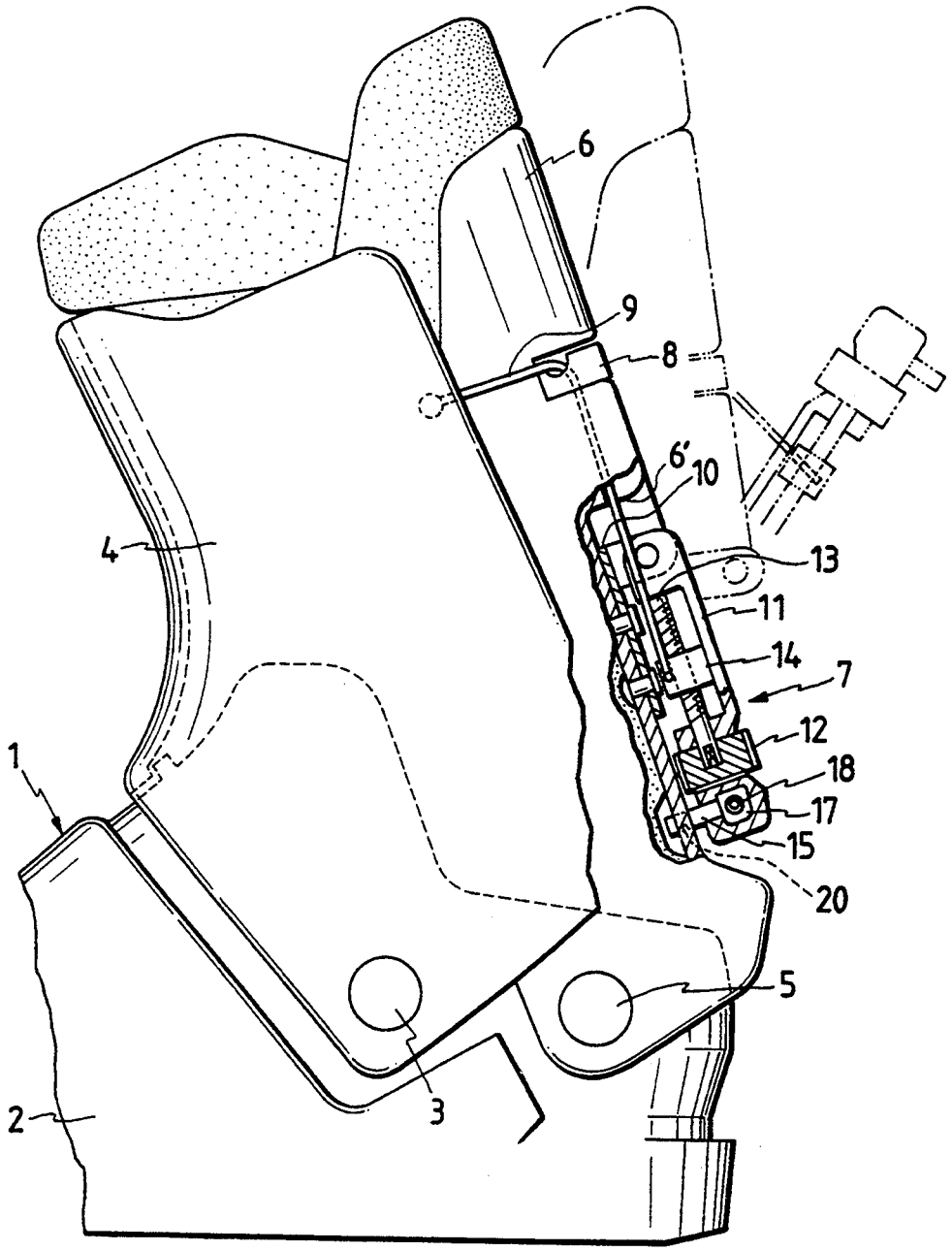
FIG. 1 is a partially cutaway front view of an embodiment of a fastening device according the invention.
Figure 2:
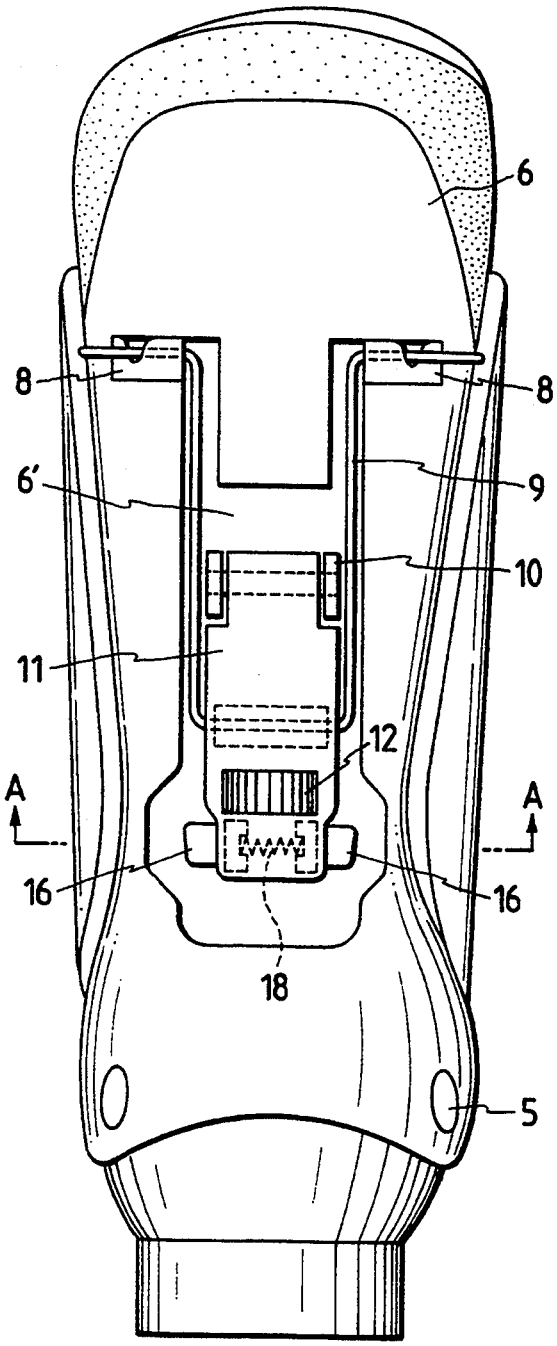
FIG. 2 is a side view of the above embodiment.
Figure 3:
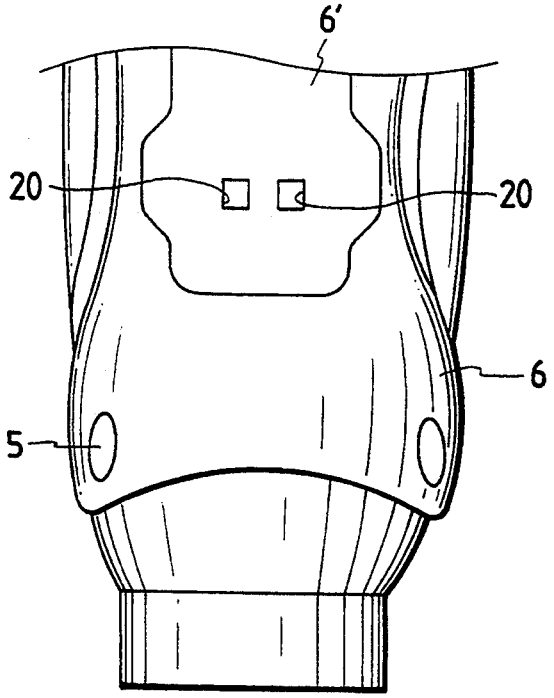
FIG. 3 is a side view of main portions of the above embodiment, showing a state thereof before a clamping lever is clamped.
Figure 4:
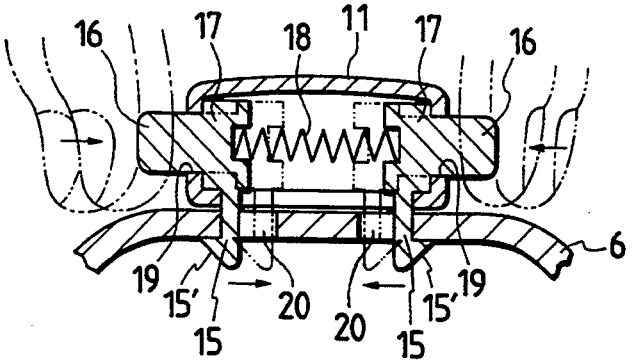
FIG. 4 is a section view taken along the line A—A in FIG. 2.

Description will be hereinafter given of the embodiments of a fastening device according to the invention with reference to the accompanying drawings. Reference character 1 designates an outer shell of a ski boot and the outer shell 1 includes a shell main body 2. The shell main body 2 includes a front cuff 4 supported by a pin 3 such that it can be inclined forwardly, and a rear cuff 6 supported by a pin 5 such that it can be freely opened backwardly. The rear cuff 6 includes two side edges which are opposed to each other and are both disposed inside the front cuff 4. Also, a cable 9 is fixedly secured to the front cuff 4. The cable 9 is connected to a fastening device 7, and a shoulder part of the cable 9 is supported by a guide portion 8 of the rear cuff 6.

The fastening device 7 includes a clamping lever 11 which is supported on a base member to fixed to a recessed portion 6' of the rear cuff 6 in such a manner that the clamping lever 11 can be freely raised up and laid down, a threaded rod 13 which is supported inside the clamping lever 11 and which has a rotary knob 12, and a nut member 14 which is threadedly engageable with the threaded rod 13 and supports the cable 9 in such a manner that the cable 9 is inserted through the nut member 14. In particular, the clamping lever 11 is disposed so as to produce the dead point action when the clamping lever 11 is raised up or laid down. That is, position of the support shaft of the clamping lever 11 is so selected that the clamping lever 11 has the dead point. Therefore, the tension acting on the cable 9 serves to keep the clamping lever 11 in place when the clamping lever 11 is laid down, and to spring the clamping lever 11 upward when the lever 11 is moved from the laid-down position to exceed the dead point. A pair of locking members 17, 17 is mounted inside the leading end portion of the clamping lever 11. Each of the locking members 17 has an engagement portion 15 projecting outside the calmping lever 11 toward the rear cuff 6 and an operation portion 16 projeting laterally outside the lever 11 through a through-hole 19. The locking members 17 are biased laterally by a spring 18 interposed therebetween. Further, the engagement portions 15, 15 are engageable with respective engagement portions 20, 20 in the from of through-holes provided in the rear cuff 6. In the drawings, reference character 15' designates an inclined surface formed on the distal end of each engagement portions 15.

In the ski boot thus constructed, when the clamping lever 11 is to be secured and held at the laid-down position, i.e. the clamping position for fastening and tightening the skier's foot to the outer shell the clamping lever 11 is simply rotated and laid down into the clamping position on the side of the rear cuff 6. Since the inclined surfaces 15', 15' of the engagement portions 15, 15 of the lock members 17, 17 is brought into contact with the edge of the engagement hole portions 20, 20 formed in the rear cuff 6 and, therefore, the lock members 17 are automatically pressed inwardly against the biasing force of the spring 18, thereby bringing the engagement portions 15, 15 of the lock members 17,17 into engagement with the engagement portions 20, 20. Alternatively, the clamping lever 11 may be laid down and rotated to the clamping position with the operation portions 16, 16 be manually depressed inwardly against the biasing force of the spring 18. In the manual depression is released, after the engagement portions 15, 15 of the lock members 17, 17 are fully inserted into the engagement portions 20, 20 respectively, then the engagement portions 15, 15 are resiliently moved laterally and brought into engagement with the engagement portions 20, 20, thereby lock the clamping lever 11 at the clamping position.

On the other hand, to release the lock of the clamping lever 11, the operation portions 16, 16 of the lock members 17, 17 is manually depressed inwardly to release the engagement of the engagement portions 15, 15 with the engagement portions 20, 20, and, thereafter, the clamping lever 11 is raised up to loosen the cable 9.

Figure 5:
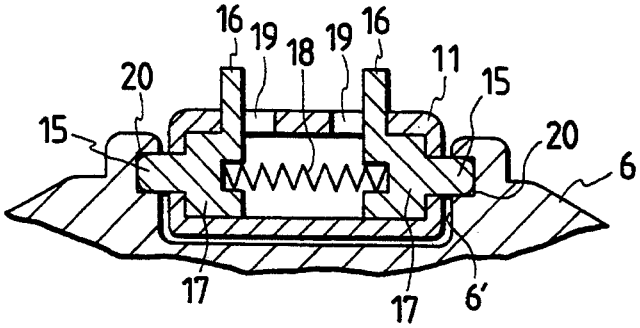
FIG. 5 is a section view of main portions of another embodiment according to the invention.
Figure 6:
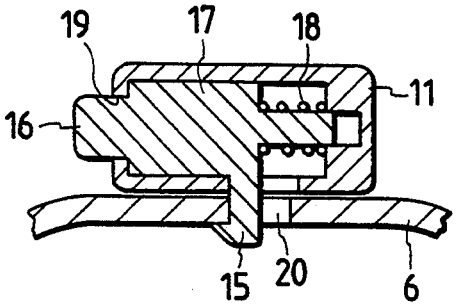
FIG. 6 is a section view of main portions of a further embodiment according to the invention.
Figure 7:
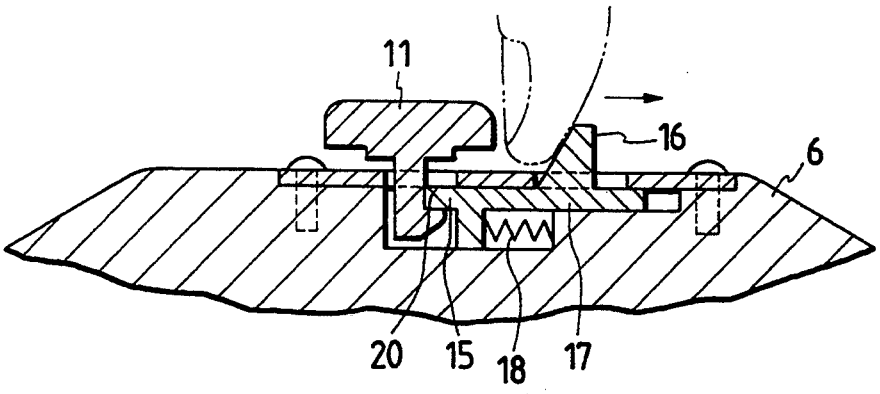
FIG. 7 is a section view of main portions of a still further embodiment according to the invention; and, FIG. 8 is a partially cutaway front view of a yet further embodiment according to the invention.
Figure 8:
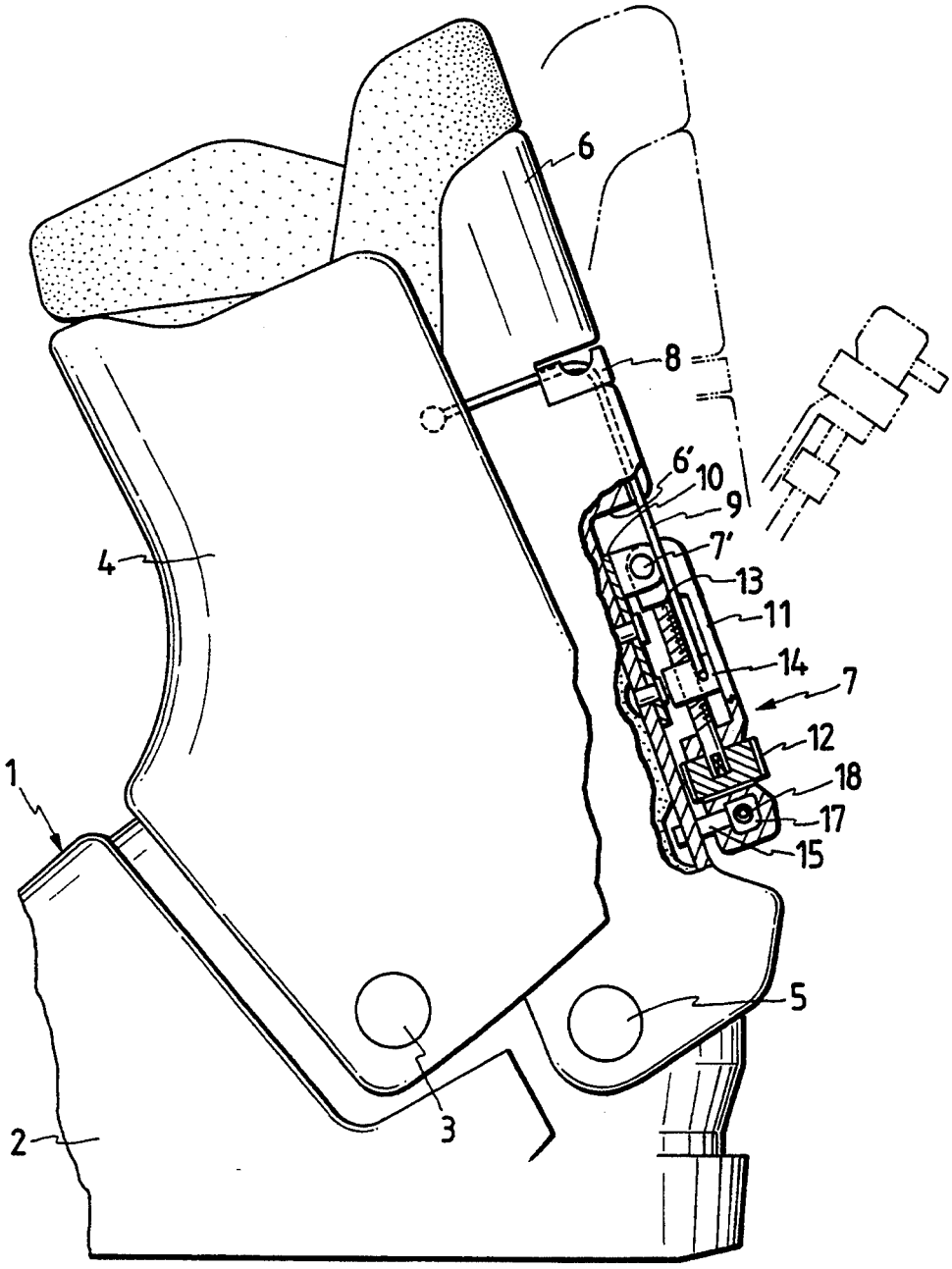

FIG. 5 shows another embodiment of a fastening device according to the invention, in which the operation portion 16 of a lock member 17 is projectingly provided on the opposite direction to a rear cuff 6 and an engagement portion 15 is provided on the side portion of the fastening device in such a manner that it can be engaged with or disengaged from an engagement portion 20 provided on the peripheral side of a recessed portion 6' of the rear cuff 6. FIG. 6 shows yet another embodiment of a fastening device according to the invention, in which a single lock member 17 is provided in a clamping lever 11. Further, FIG. 7 shows still another embodiment according to the invention, in which a movable lock member 17 including an engagement portion 15 and an operation portion 16 is provided in the rear cuff 6 and a stationary engagement portion 20 in the from of claw is provided on a clamping lever 11. FIG. 8 shows further another embodiment of a fastening device according to the invention, in Which the support shaft 7' for a clamping lever 11 is positioned inwardly relative to a cable 9 (that is, on the side of a rear cuff 6) so as not to utilize the dead point action. In this embodiment, during the clamping state of the clamping lever 7, the clamping lever 11 is always urged by means of the tension acting on the cable 9 in a direction to rotate the clamping lever 11 away from the laid-down position to a released position wherein the clamping pressure on the foot is relieved. Therefore, the fastening force of the fastening device can be released simply by releasing the lock of a lock member 17 of the clamping lever 11. Since it is not necessary to exceed the dead point during the operation of the clamping lever 11, the force required for the operation can be reduced. Further, this embodiment enables a skier to take off ski boots quickly easily.

The above-mentioned embodiments respectively relate to a fastening device of a rear entry type, however, it is quite natural that they can be also applied to a fastening device of a front entry type.

As has been described heretofore, according to the invention, a clamping lever of a fastening device positioned at its clamping portion is further secured and held by a lock member. This structure makes it sure to prevent the clamping action of the clamping lever from being released even by heavy shocks given when a skier skis on a quite bumpy slope. This can also apply to a fastening device which does not utilize a dead point action in clamping and releasing a clamping lever and, in this case as well, the clamping lever can be clamped and released smoothly and easily.

What is claimed is:

1. A ski boot for receiving a skier's foot within an outer shell thereof, comprising:

a clamping lever provided on said outer shell and pivotally movable to a predetermined position for tightening said outer shell onto said skier's foot;

means for biasing said clamping lever away from said predetermined position; and engagement means for operatively engaging said clamping lever with said outer shell and securing said clamping lever at said predetermined position, wherein a pivoting force necessary to pivot said clamping lever away from said predetermined position upon release of said engagement means is reduced by said biasing means continuously by the pivoting of the clamping lever from the predetermined position to a released position.

2. The ski boot according to claim 1, wherein said clamping lever pivots about a support shaft, and said biasing means comprises a tensioning cable fixedly attached to said clamping lever at a position opposite said shell relative to said support shaft when said lever is moved to said predetermined position so as to urge said clamping lever away from said predetermined position.

3. A ski boot for receiving a skier's foot within an outer shell thereof, comprising:

a clamping lever provided on said outer shell and pivotally movable to a predetermined position for tightening said outer shell onto said skier's foot;

means for biasing said clamping lever away from said predetermined position; and engagement means for operatively engaging said clamping lever with said outer shell and securing said clamping lever at said predetermined position, wherein said engagement means includes an engagement projection projecting outside said clamping lever and an engagement recess provided in said outer shell for engagement with said engagement projection, and wherein a pivoting force necessary to pivot said clamping lever away from said predetermined position upon disengagement of said engagement means is reduced by said biasing means continuously by the pivoting of the clamping lever from the predetermined position to a released position.

4. The ski boot according to claim 1, wherein said engagement means further includes a spring for biasing said engagement projection to be engaged with said engagement recess.

5. The ski boot according to claim 4, wherein said engagement means further includes an operation portion projecting outside said clamping lever for manually moving said engagement projection against a biasing force of said spring to be disengaged from said engagement recess.

6. The ski boot according to claim 4, wherein said engagement projection has a slanted surface abuttable against an edge of said engagement recess to move said engagement claw portion against a biasing force of said spring.

7. The ski boot according to claim 3, wherein said engagement projection projects laterally outside said clamping lever, and further comprising a spring for biasing said engagement projection toward said engagement recess.

8. The ski boot according to claim 7, wherein said engagement means further includes an operation portion projecting outside said clamping lever for manually moving said engagement projection against a biasing force of said spring to be disengaged from said engagement recess.

9. The ski boot according to claim 3, wherein said engagement means includes an engagement slider slidably provided in said recess for engagement with said engagement projection.

10. The ski boot according to claim 9, wherein said engagement means further includes a spring for biasing said slider to be engaged with said engagement projection.

11. The ski boot according to claim 10, wherein said engagement means further includes an operation portion projecting outside said outer shell for manually moving said slider against a biasing force of said spring to be disengaged from said engagement projection.

12. The ski boot according to claim 3, wherein said outer shell is defined by an outer surface and an inner surface, said clamping lever being adjacent to said outer surface at said predetermined position, said recess defining a hole passing from said outer surface to said inner surface, and said engagement projection comprises a claw member engaging said inner surface.

* * * * *